US005584345A

United States Patent [19]

Joy

[11] Patent Number: 5,584,345

[45] Date of Patent: Dec. 17, 1996

[54] SAFETY RING FOR BOTTOM OF FIRE EXTINGUISHER

[76] Inventor: Rick Joy, 5588 Calle Arena, Carpinteria, Calif. 93013

[21] Appl. No.: 338,419

[22] Filed: Nov. 14, 1994

Related U.S. Application Data

[63] Continuation-in-part of Ser. No. 114,399, Aug. 30, 1993, abandoned, which is a continuation of Ser. No. 938,451, Aug. 31, 1992, abandoned, which is a continuation-in-part of Ser. No. 638,791, Jan. 7, 1991, abandoned.

[51] Int. Cl.[6] ..... A62C 13/76

[52] U.S. Cl. ..... 169/51; 169/30; 248/79; 220/632; 220/730; 222/530

[58] Field of Search ..... 169/51, 30, 71, 169/74, 89; 222/530, 538; 248/146, 154, 75, 79, 213.2; 220/654, 655, 632, 733, 601, 729, 730, DIG. 6

[56] References Cited

U.S. PATENT DOCUMENTS

| | | | |
|---|---|---|---|
| 1,588,859 | 6/1926 | Sossong . | |
| 2,404,777 | 7/1946 | Gaines . | |
| 2,521,193 | 9/1950 | Thompson | 169/51 |
| 2,541,554 | 2/1951 | Smith . | |
| 2,683,579 | 7/1954 | Wallace . | |
| 3,259,194 | 7/1966 | McCrossan . | |
| 3,339,638 | 9/1967 | Huthsing . | |
| 3,638,826 | 2/1972 | Barker et al. . | |
| 3,654,875 | 4/1972 | Vik . | |
| 3,963,226 | 6/1976 | Jankowski, Jr. . | |
| 3,998,347 | 12/1976 | Mahl . | |
| 4,082,200 | 4/1978 | Guest et al. . | |
| 4,141,459 | 2/1979 | Eli, Jr. . | |
| 4,241,839 | 12/1980 | Alberghini . | |
| 4,299,161 | 11/1981 | Collias . | |
| 4,511,055 | 4/1985 | Carlson . | |
| 4,806,771 | 2/1989 | Mallory . | |
| 4,880,130 | 11/1989 | Blake . | |

FOREIGN PATENT DOCUMENTS

| | | |
|---|---|---|
| 612063 | 10/1926 | France . |
| 655876 | 5/1935 | Germany . |
| 3435470 | 5/1985 | Germany . |
| 235322 | 6/1925 | United Kingdom . |
| 588045 | 5/1947 | United Kingdom . |
| 934246 | 8/1963 | United Kingdom . |
| 991874 | 5/1965 | United Kingdom . |

OTHER PUBLICATIONS

Sketch of Model 240 fire extinguisher, Amerex Corp., Trussville, AL 35173 Dec. 1986.

*Primary Examiner*—Gary C. Hoge
*Attorney, Agent, or Firm*—J. Mark Holland

[57] ABSTRACT

A safety ring for an end of a fire extinguisher is characterized by an underlying portion adjacent the lowermost end of the extinguisher. Flange portions extend upwardly from the underlying portion about the lowermost end of the extinguisher, to protect same and to enhance the retention of the ring on said extinguisher. The ring has a preferably U-shaped cross-section, and alternatively or additionally may be retained in operative protective relationship with the extinguisher by an adhesive substance or the like. Sloping upper edges of the flange portions provide desirable benefits, including reducing the risk of inadvertent dislodgment of the ring from the extinguisher and reducing the collection of water, dirt and the like on the edge of the flange. One or more holes may be provided in the ring to permit drainage of fluids and to permit easier cleaning of the ring. Hose-retaining means may be integrally provided with the ring.

11 Claims, 2 Drawing Sheets

SAFETY RING FOR BOTTOM OF FIRE EXTINGUISHER

This is a continuation-in-part of application Ser. No. 08/114,399, filed Aug. 30, 1993, now abandoned, which was a continuation of application Ser. No. 07/938,451, filed Aug. 31, 1992, now abandoned, which was a continuation-in-part of application Ser. No. 07/638,791, filed Jan. 7, 1991, now abandoned.

BACKGROUND OF THE INVENTION

This invention relates to a safety ring for the bottom of fire extinguishers, especially those which may be located in hazardous, volatile environments and which may be subjected to rough handling and harsh and/or extreme conditions.

Protective rings exist for various objects, such as garbage cans, buckets and domestic receptacles, to prevent damage to the can, bucket, etc. as well as the surfaces upon which they may be placed. Exemplary of such rings is Great Britain Pat. No. 235,322 to Kay.

The use of a protective ring for the bottom of fire extinguishers is shown, for example, in U.S. Pat. No. 2,404,777 to Gaines (see Gaines' rubber channel 12). German Pat. No. 3435470-A to Salmen discloses a soft elastic plastics footplate glued over the bottom of a portable fire extinguisher. The present invention is an improvement over these prior art fire extinguisher devices.

Exemplary of the potentially destructive environments in which such fire extinguishers may be utilized is that of an off-shore drilling rig. Safety considerations and regulations mandate that fire extinguishers be readily available on such rigs. Typically, metallic fire extinguishers are positioned at various locations on such a rig for ready accessibility.

With respect to these types of fire extinguishers, the "wear surface" is normally the bottom of the extinguisher. When the extinguisher is handled, used, replaced and/or repositioned, the bottom commonly confronts other metallic or hardened surfaces, and frequently is exposed to corrosive liquids or materials such as water, saltwater, etc.

Moreover, because of the environments in which the extinguishers are utilized and because of the weight of the fire extinguishers, the fire extinguishers may not be handled with great finesse. When typical fire extinguishers are full, they may weigh as much as fifty pounds. Even the processes of servicing the fire extinguishers (such as checking or refilling a fire extinguisher) may scrape or damage the bottom of the extinguisher.

Other harsh environments in which such fire extinguishers may be damaged include industrial and mining operations. Such environments sometimes are exposed to flammable gasses, liquids and other materials. Indeed, the potential flammability of materials in such environments is frequently the reason for a fire extinguisher to be present in the first place.

Many such extinguishers (including specifically the bottoms and other wear surfaces thereof) are fabricated from metal or other material. The contact of a metallic extinguisher against a metallic drilling rig surface, for example, may cause dangerous sparking, increasing the peril of these already hazardous situations, and increasing the risk of explosion and fire—the very risk that the fire extinguisher is present to address.

Metal fire extinguishers are also subject to rust or corrosion. For that reason, as well as for aesthetic and other reasons, the extinguishers are commonly painted or otherwise coated with a protective paint or other material. The aforementioned rough handling commonly dents and/or scrapes the bottom of the extinguisher, damaging the container as well as any such protective paint or corrosion-resistive coating applied thereto.

Obviously, damage to such protective coating permits the ready entry of the aforementioned corrosive liquids or materials, initiating rust or similar deterioration to the extinguisher. Such rusting action may eventually migrate up the sides of the extinguisher and destroy the aesthetic and, potentially, the functional aspects of the container.

This is especially important when extinguishers of the aforementioned type are pressurized, as are many fire extinguishers. Some extinguishers are designed to be "instantly pressurized" just prior to or contemporaneously with their use, by an expedient such as an associated $CO_2$cartridge or the like. With respect to such extinguishers, the aforedescribed deterioration of the container may result in an unsafe condition. Among other things, the deteriorated bottoms of such extinguishers have sometimes "blown-out" from the internal pressure, especially in those extinguishers employing the aforementioned "instant pressurization". In addition to harming persons in the area at the time of such a blow-out, the container obviously would not be available for use after such a blow-out. For that reason, a preventable fire might not be prevented.

Additionally, the work surfaces of, for example, a drilling rig may also be metallic and subject to corrosion. Undesirable and damaging contact from fire extinguishers may harm the work surface as well as the extinguisher itself.

The useful life of any such extinguisher certainly may be shortened by the aforementioned deterioration. Moreover, because one of the main purposes of fire extinguishers is to provide safety and peace of mind, some persons may sense a reduced feeling of confidence and safety if the fire extinguisher is corroded or rusty. This feeling may exist regardless of whether the extinguisher is actually satisfactory for use.

Many fire extinguishers include discharge nozzles and/or hoses which are commonly clipped to the side of the tank when not in use. Prior art clip designs have numerous shortcomings, including their tendency to deteriorate and break (from weather, rough handling, etc.) and even to cause damage to the tank itself. Regarding this latter point, prior art clips are commonly banded onto the neck or body of the tank, and moisture can accumulate under the strap or band, increasing the likelihood of rust at that location. The bands or straps are also prone to loosening and/or rotation about the tank, decreasing the reliability of the intended retention of the discharge hose at a particular location on the tank.

OBJECTS AND ADVANTAGES OF THE INVENTION

It is, therefore, an object of my invention to provide a safety ring suitable for the bottom of a fire extinguisher, which is useful to overcome the abovedescribed problems.

Another object of my invention is the provision of a ring of the aforementioned character which is preferably fabricated from a nitrile-based elastomer or similar resilient material, so that the ring will cushion any contact between the extinguisher and confronting surfaces, preventing sparking or other detrimental occurrences.

It is a further object of my invention to provide a ring of the aforementioned character which is relatively easy and affordable to manufacture and utilize. The ring of my invention is preferably of a configuration which permits it to be "snapped-on" to the bottom of an extinguisher and retained thereon by the hoop strength of the ring itself. Such a snap-on application permits the guard to be removable for purposes of inspection of the extinguisher or for reuse on another extinguisher.

Yet another object of my invention is the provision of a safety ring of the aforementioned character which includes an outer flange portion to protect the lower outer surfaces of the extinguisher and to assist or achieve the retention of the ring on the extinguisher. Alternatively or additionally, the permanent or temporary retention of the ring on the extinguisher may be achieved by the application of adhesive means such as glue or the like.

Sloping upper edges of the preferred flange portions of the guard provide desirable benefits, including those of reducing the risk of inadvertent dislodgment of the guard from the canister and reducing the collection of water, dirt, debris and the like on the edge of the flange.

An alternative embodiment of my invention includes drainage holes in the ring, whereby any fluids or debris that might otherwise accumulate in the ring can drain or be conveniently cleaned therefrom.

Moreover, use of the ring of my invention may enhance the engagement of an extinguisher with various brackets designed to retain the extinguisher in a specific location. For example, in vehicles such as trucks, small fire extinguishers may tend to "rattle" annoyingly within their mounting bracket while the vehicle is in motion. Use of the ring of my invention reduces or eliminates the movement of the extinguisher with respect to the bracket and, correspondingly, reduces or eliminates the noise and possible wear associated therewith.

Still another object of my invention is the provision of a ring of the aforementioned character which can extend the useful life of extinguishers by preventing or reducing damage to the extinguishers. This extension of useful extinguisher life can provide a substantial economic benefit to purchasers of such extinguishers, especially those that purchase large quantities of extinguishers.

Yet another object of my invention is the provision of a ring of the aforementioned character, in which a hose-retaining means such as a clip is integrally molded into the protective ring. In a preferred embodiment, the clip includes an internal strengthening member such as a stainless steel member, with the strengthening member surrounded by a coating of rubber or other suitable material.

Other objects and advantages of the invention will be apparent from the following specification and the accompanying drawings, which are for the purpose of illustration only.

DESCRIPTION OF PREFERRED EMBODIMENT

Figures 1, 2, 3:
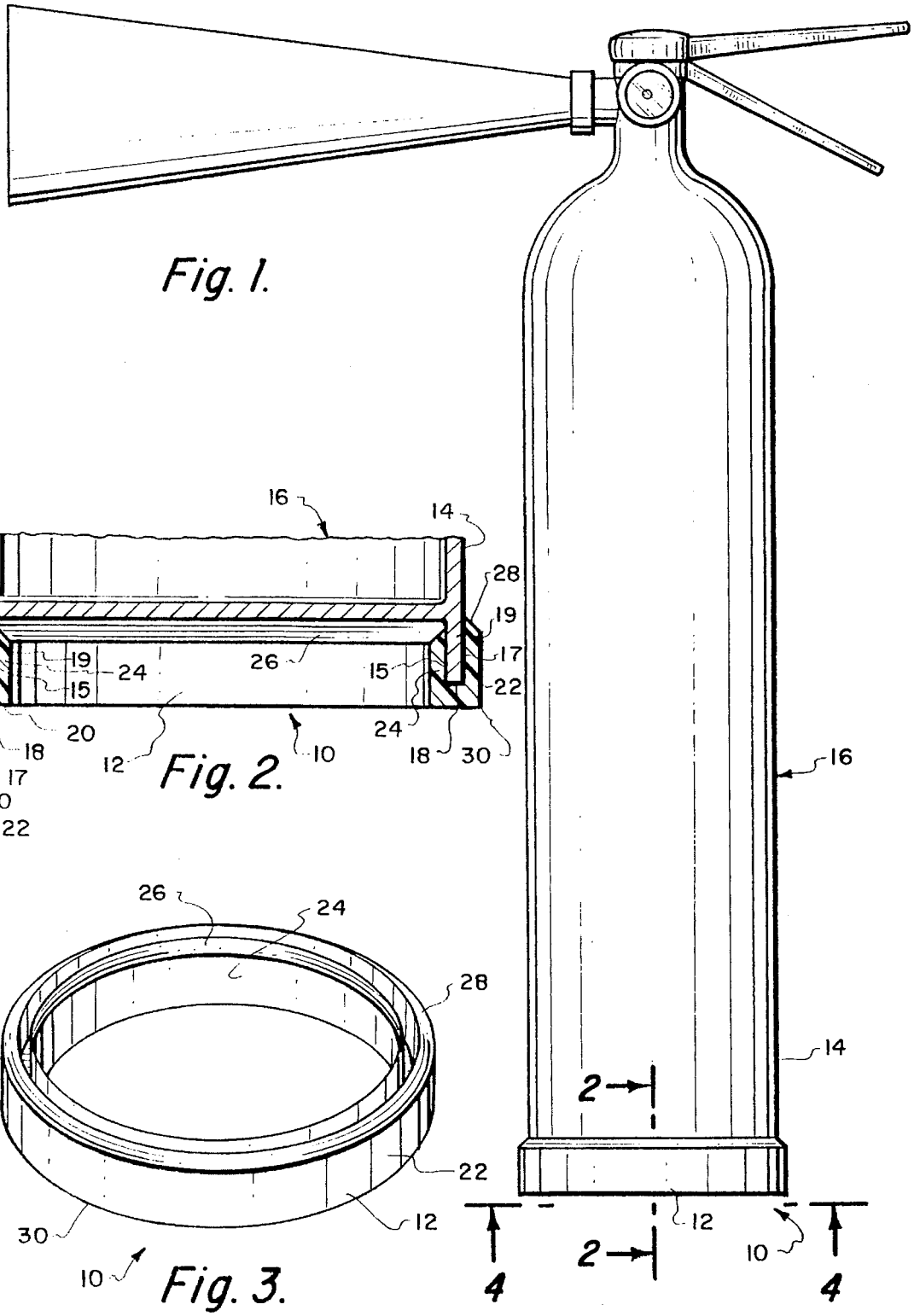
FIG.1 is a front elevation view of a fire extinguisher on the lower portion of which is operatively disposed a preferred embodiment of a ring constructed in accordance with the teachings of the invention.
FIG. 2 is a section view taken along line 2—2 of FIG. 1.
FIG. 3 is an isometric view of a preferred embodiment of a ring constructed in accordance with the teachings of the invention.
Figure 5:
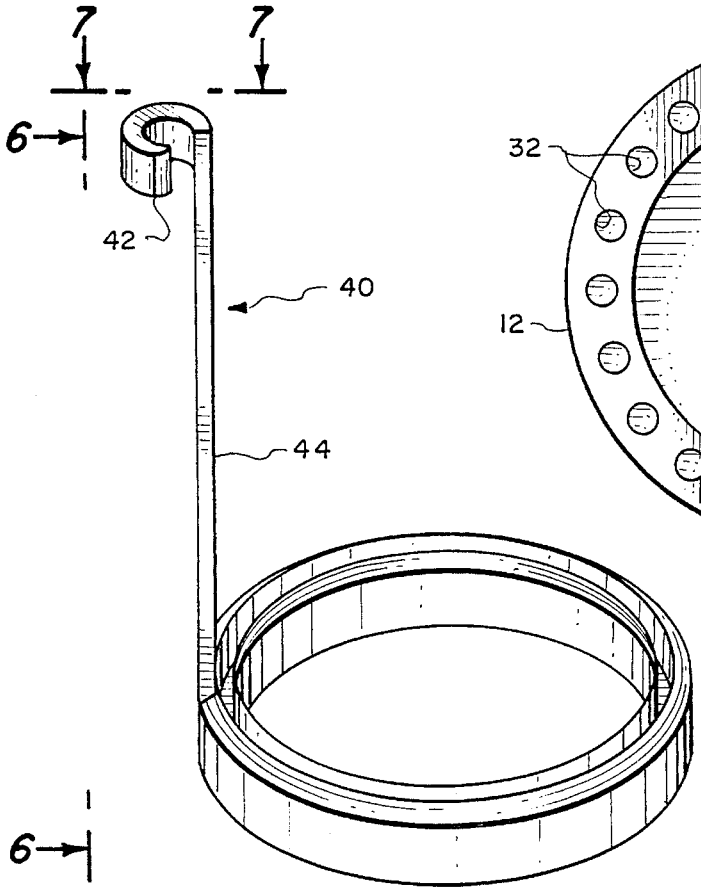
FIG. 5 is an isometric view of an alternative embodiment of the invention, including a preferred embodiment of a hose-retaining means.

Referring to the drawings, and particularly to FIG. 3 thereof, I show a preferred embodiment of a ring 10 such as a protective ring 12 constructed in accordance with the teachings of the invention. As illustrated in FIG. 1, the ring 10 is adapted to be operatively retained on the lower end 14 of a fire extinguisher 16.

In the preferred embodiment, the ring includes an underlying portion 20, FIG. 2, operatively disposed below the lowermost end 18 of the extinguisher 16.

Typically, fire extinguishers incorporate a downwardly extending flange 19 at the lower end thereof. Because of the normally circular cross-sectional configuration of such fire extinguishers, the flange 19 constitutes an annulus.

As used herein, directions such as lowermost or bottom will be understood by those skilled in the art to indicate the relative position of a portion of the extinguisher when the extinguisher is in its normally upright position The preferred embodiment of the ring of my invention further includes a first flange portion 22 operatively associated with the underlying portion 20. The first flange portion 22 serves a number of purposes, including protection of the outer edge 17 of the bottom portion 14 of the extinguisher 16. In addition, the first flange portion 22 is preferably dimensioned and located to accomplish desired retention of the ring on the extinguisher through mating engagement with the flange 19. For this purpose, the ring is preferably fabricated from a nitrile-based elastomer or similar material having sufficient hoop strength and/or frictional adherence characteristics to retain the ring in operative relationship on the extinguisher.

In an alternative application, the desired adherence of the ring on the extinguisher may be achieved by temporarily or permanently attaching the ring to the extinguisher with glue or similar adhesive means. Those skilled in the art will understand that such adhesive means may be utilized as the sole means for adhesion between the ring and the extinguisher, or may supplement the frictional gripping of the first flange portion 22.

Although the ring of the preferred embodiment is illustrated as having an annular construction, those skilled in the art will understand that the ring may be provided in a wide variety of configurations to matingly engage with correspondingly-shaped canisters. Moreover, the underlying portion 20 may constitute any of several configurations, such as a solid circular disk, and still provide the beneficial characteristics described herein.

Those skilled in the are will understand relative benefits of certain constructions as compared to other constructions. For example, benefits of annular construction as compared to a ring having a flat circular disk bottom include lower per unit material requirements, correspondingly lower per unit weight and transportation costs, and potentially an improved ease of handling. As indicated, however, the preferred embodiment is adapted for use on an extinguisher 16 having a downwardly extending flange 19 at the bottom thereof. In such an application, a second flange portion 24 may be provided in operative association with the underlying portion 20. The second flange portion 24 performs similar functions as does the first flange portion 22, but is preferably located so as to protect another surface of the extinguisher, such as the interior surface 15.

The ring of the invention may be fabricated from any of a variety of methods, including injection molding, vacuum forming or the like. Alternatively, the ring of the preferred embodiment may be fabricated from an appropriately cross-sectioned elastomeric extrusion (not shown). In such a method, the extrusion would be cut to an appropriate length and bent into a configuration corresponding to the portion of the extinguisher to be protected. The ends of the piece of extruded material would then be joined or sealed together by glue or the like to form a ring similar to the ring of FIG. 1. Alternatively or additionally, the extruded piece could be glued onto the desired location on the extinguisher to accomplish the protective functions of the ring.

In effect, and as will be understood by those skilled in the art, the preferred embodiment of the ring of my invention comprises an annular elastomeric ring having a substantially U-shaped cross-section adapted to be received about an annulus on the lower end of an extinguisher.

Further details of the preferred construction of the ring of my invention include tapered top edges 26 and 28 of the flange portions 24 and 22, respectively. Among other things, these tapered edges prevent or minimize the retention of debris and water on the upper edge of the flanges 24 and 22. Additionally, the sloped face of the external edge 28 reduces the risk that the ring will be inadvertently caught on a person or object and dislodged from engagement with the extinguisher.

In the preferred embodiment, the height of the flange portions 22 and 24 is sufficient to provide the desired protection of the extinguisher as well as the gripping and hoop strength for retention of the ring on the extinguisher. For flange portions such as the second flange portion 24, the height must obviously be sufficiently small to permit the ring to be properly seated on the extinguisher.

Furthermore, the external bottom corners 30 of the ring are preferably somewhat square or "sharp" (approaching or achieving an absence of roundedness) in order to minimize undesirable "tipping" of the extinguisher when it rests on the ring. Various modifications to the cross-sectional shape of the ring may, of course, be made without departing from the teachings of the invention.

Figure 4:
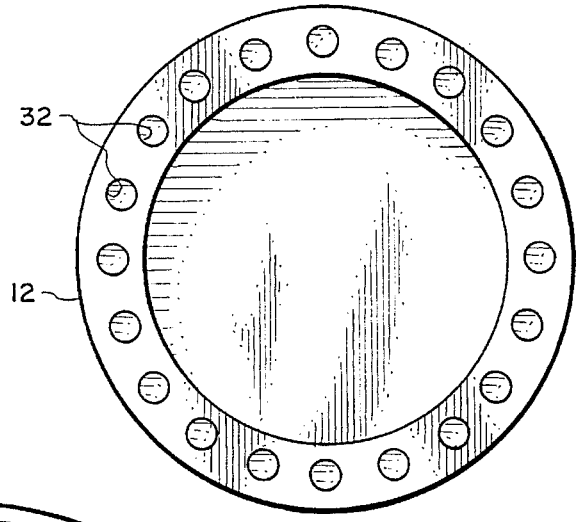
FIG. 4 is a bottom view of an alternative embodiment of the invention, such as might be taken along line 4—4 of FIG. 1.
Figure 7:
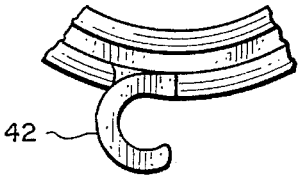
FIG. 7 is a top view taken along line 7—7 of FIG. 5.
Figure 6:
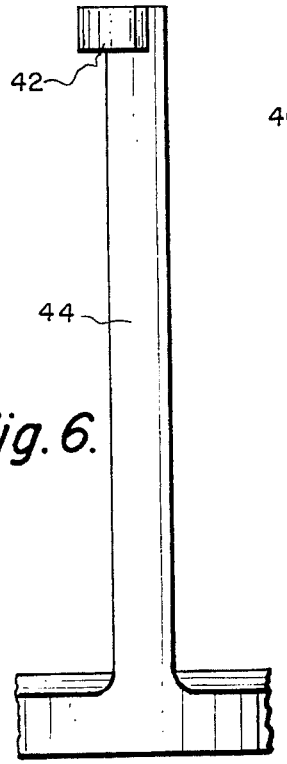
FIG. 6 is a side elevational view taken along line 6—6 of FIG. 5.
Figure 8:
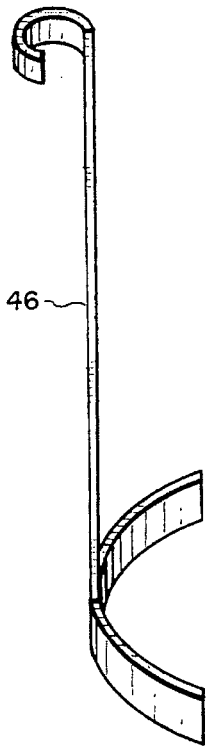
FIG. 8 is a preferred embodiment of a strengthening member which may be used in connection with the embodiment of FIG. 5.
Figure 9:
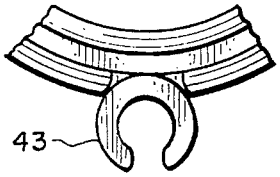
FIG. 9 is similar to FIG. 7, but illustrates one of the many alternative embodiments of a hose-retaining means.

Additionally, one or more holes such as holes 32, FIGS. 2 and 4, may be provided in the underlying portion 20. These holes permit drainage of any liquids which may accumulate in the interior of the ring 12, and also permit dirt and debris to be more effectively cleaned from the ring by permitting such drainage.

In the embodiment of FIGS. 5–9, a hose-retaining means 40 is illustrated as being integrally molded with the protective ring. The preferred hose-retaining means 40 includes a clip portion 42 sized and configured to operatively retain therein the discharge hose or nozzle (different from the nozzle shown in FIG. 1) of the extinguisher. One of the many alternative configurations of clip portions is illustrated as clip portion 43, FIG. 9.

To facilitate this engaging retention and to help prevent the end of the hose or nozzle from being damaged, the clip portion 42 may be spaced from the bottom of the extinguisher by the provision of an extending portion 44. To enhance the retention function and the ability of the extending portion 44 to maintain a desired position (such as alongside the wall of the extinguisher tank), a strengthening member 46 may be formed from stainless steel or other suitably strong material, and thereafter be molded into the protective ring.

Those skilled in the art will understand that the hose-retaining means 40 may be fabricated in a wide variety of ways without departing from the scope of the invention. For example, the clip portion 42 may be adjacent the ring itself, with no extension portion 44. The extension portion 44 and clip portion 42 may be molded from a strong, relatively hard plastic so that no strengthening member 46 is required. Where a strengthening member 46 is used, the member 46 may itself be "exposed" on the extension portion and clip portion, although such an embodiment increases the likelihood of scraping or other slight damage to the extinguisher, the hose, and/or to persons using the device.

The ring of my invention has been described with some particularity but the specific designs and constructions disclosed are not to be taken as delimiting of the invention in that various obvious modifications will at once make themselves apparent to those of ordinary skill in the art, all of which will not depart from the essence of the invention and all such changes and modifications are intended to be encompassed within the appended claims.

I claim:

1. A safety ring for the bottom of a fire extinguisher, comprising an underlying portion disposed below an end of the extinguisher when the extinguisher is in a normally upright position, and a first flange portion operatively associated with said underlying portion and extending upwardly therefrom adjacent an exterior surface of the end and in gripping engagement therewith to retain said ring in association with the fire extinguisher, whereby said underlying portion and said first flange portion protect the end from potentially dangerous contact with adjacent surfaces or objects, and wherein said ring includes hose retaining means directly connected thereto; said hose retaining means including a clip portion spaced above said ring and affixed to an extension portion, said extension portion being affixed to said ring and extending upwardly therefrom.

2. The ring of claim 1, in which an upper edge of said first flange portion is tapered.

3. The ring of claim 1, including a second flange portion operatively associated with said underlying portion and extending upwardly therefrom adjacent a second surface of said end.

4. The ring of claim 1, in which said ring is fabricated from a nitrile-based elastomer.

5. The ring of claim 1, further including drainage means.

6. An annular ring for a normally lower end of a fire extinguisher, which lower end includes a downwardly extending flange member, said ring having a substantially U-shaped cross-section grippingly engaging said downwardly extending flange member to retain said ring on the fire extinguisher and thereby protect said flange member from potentially dangerous contact with confronting surfaces, and wherein said ring includes hose-retaining means directly connected thereto; said hose retaining means including a clip portion spaced above said ring and affixed to an extension portion, said extension portion being affixed to said ring and extending upwardly therefrom.

7. The ring of claim 6, in which normally upper edges of said U-shaped cross section form an obtuse angle with respect to immediately adjacent contacting surfaces of said extinguisher.

8. The ring of claim 6, in which said U-shaped cross section retains said ring in operative protective relationship with said extinguisher.

9. The ring of claim 6, including one or more holes in said U-shaped cross section.

10. The ring of claim 6 or claim 1, including an internal strengthening member in said hose-retaining means.

11. The ring of claim 10, in which said internal strengthening member is a metallic member surrounded by a protective coating.

* * * * *